United States Patent [19]

Lasley

[11] Patent Number: 4,579,269

[45] Date of Patent: Apr. 1, 1986

[54] TICKET FEED MACHINE

[76] Inventor: Robert A. Lasley, P.O. Box 1000, Farmingdale, N.J. 07727

[21] Appl. No.: 649,497

[22] Filed: Sep. 11, 1984

[51] Int. Cl.[4] ..... B65H 20/00

[52] U.S. Cl. ..... 226/188; 226/144

[58] Field of Search ..... 226/38, 39, 143–146, 226/147, 148, 149, 151, 152, 168, 181, 188, 125; 225/10, 11; 221/71

[56] References Cited

U.S. PATENT DOCUMENTS 3,337,148 8/1967 Murphy ..... 226/188 X 3,511,426 5/1970 Whitmore et al. ..... 226/145

*Primary Examiner*—Leonard D. Christian

*Attorney, Agent, or Firm*—Witherspoon & Hargest

[57] ABSTRACT

A ticket strip feed machine is disclosed having a ticket strip feed mechanism, a power source, and gearing connecting the power source to the feed mechanism. The feed mechanism has a rotatable ticket strip feed wheel connected to the gearing for rotation thereby. The feed wheel is provided with at least one set of toothed elements for engaging the ticket strip to prevent additional feeding movement of the ticket strip when a force is exerted on the ticket strip in the direction of feed. In addition, the feed wheel is provided with a plurality of toothed elements for engaging the ticket strip to feed same upon rotation of the feed wheel. The gearing includes a worm gear connected to the power source and a spur gear meshing with the worm gear and connected to the feed wheel to drive same.

6 Claims, 6 Drawing Figures

TICKET FEED MACHINE

SUMMARY AND OBJECTS OF THE INVENTION

This invention relates to ticket feeders and more particularly to a ticket feeder provided with means for preventing the withdrawal of unauthorized tickets either during or after the feed cycle has been completed.

Motorized ticket feeders have been on the commercial market for many years. Many of such feeders were so constructed that even after the motor driven feed was cut off it was still possible to withdraw tickets by merely pulling on the end of the ticket strip. Many ways have been devised to pevent such. One way is to dispense the ticket in cut form with no residual portion available at the dispenser edge. With nothing to grip, obviously no tickets can be withdrawn. Other machines have covers for the dispensing opening so that when the dispensing operation is over, the dispensing opening is positively closed. Obviously, the two solutions set forth above require additional mechanisms all of which add to the cost of the ticket dispenser.

It is with this problem in mind that one of the objects of this invention is to produce a ticket feeder which will prevent the withdrawal of tickets after the feed cycle has been completed.

It is another object of this invention to provide a ticket feeder with ticket strip feed means combined with additional means which will prevent withdrawal of tickets after the feed cycle has been completed.

It is yet another object of this invention to provide a motorized ticket feeder having means for preventing the withdrawing of additional tickets during the feed cycle.

It is a still further object to provide a motorized ticket feeder having a worm gear drive to prevent reverse movement.

It is yet another object to provide a motorized ticket feeder having a feed wheel with opposed sets of teeth thereon, one for feed and one for braking so that when the feed cycle is completed, further feeding upon a pull on the ticket strip in the feed direction will be prevented by engagement of the braking teeth.

The foregoing and additional objects and advantages will become more apparent when taken in conjunction with the following detailed description and drawings describing a preferred embodiment of this invention.

IN THE DRAWINGS

FIG. 1 is an elevational view of the ticket feed unit looking in a direction opposite to the ticket feed, FIG. 2 is a top plan view of the ticket feed unit showing, in phantom, the strip of tickets as fed through the unit, FIG. 3 is an elevational view of the ticket feed unit rotated 180° from the view of FIG. 1, FIG. 4 is a side elevational view illustrating the power train from the motor to the shaft mounting the ticket feed wheel, FIG. 5 is a cross sectional view taken along line 5—5 of FIG. 1 and illustrating the manner in which the strip of tickets is fed through the unit and, FIG. 6 is an enlarged elevational view showing the feed wheel assembly and the back up roll.

DETAILED DESCRIPTION

Figure 1:
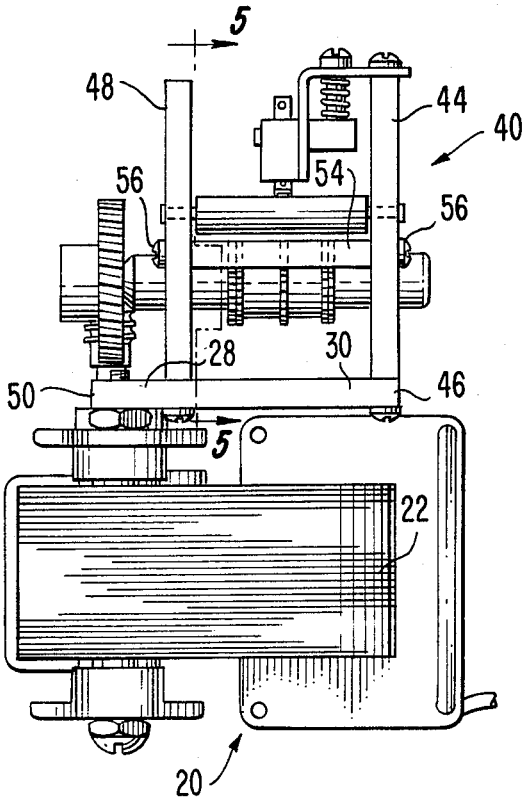
Figure 3:
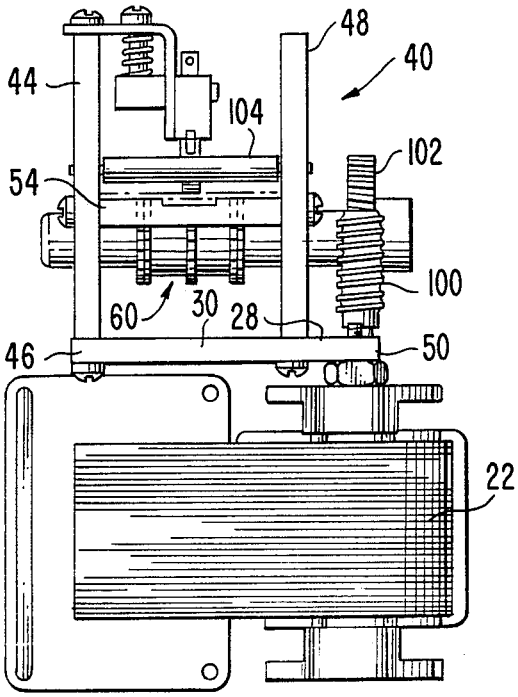
Figure 2:
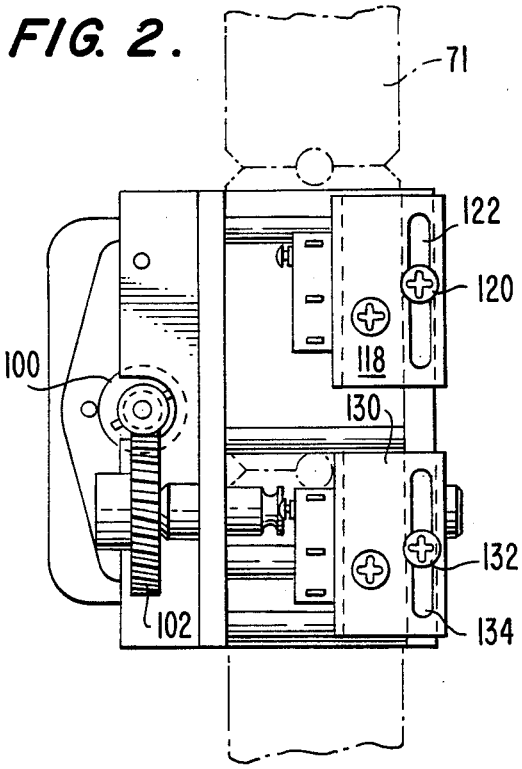
Figure 4:
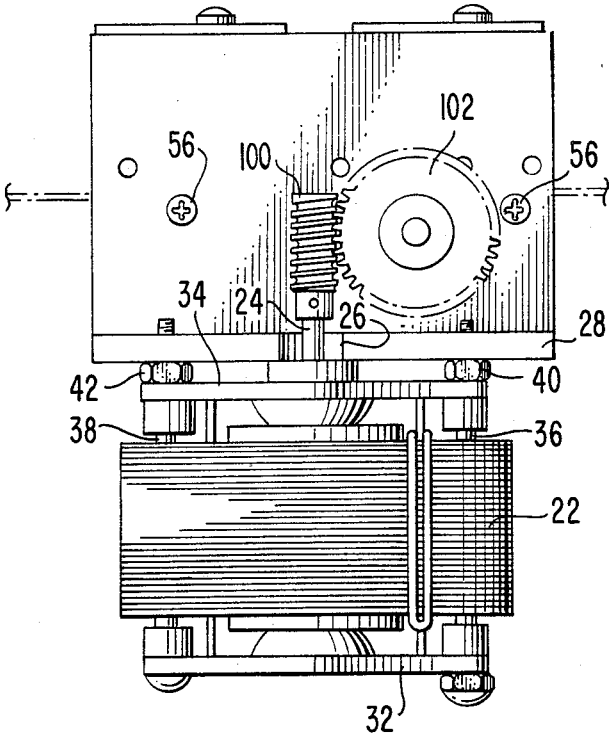

As best illustrated in FIGS. 1–4, the ticket feed unit 20 comprises an electric motor 22 adapted for connection to the conventional 115 volt 60 Hertz power supply. A rotating motor shaft 24 extends upwardly from the motor 22 and passes through a recess 26 in the flange 28 of base 30. More specifically, the motor shaft 24 is rotatably carried by a lower bearing and support 32 and upper bearing and support 34 which are held in assembled position by means of through bolts 36 and 38 and cooperating nuts 40 and 42 respectively. In addition it is through bolts 36 and 38 which threadedly pass through base flange 28 to mount the base 30 in proper alignment with the motor shaft 24.

The ticket feed assembly 40 comprises a generally rectangular base 30 having a first side plate 44 extending vertically upward from edge portion 46 of the base 30. A second side plate 48 extends vertically upward from the base 30 parallel to the first side plate 44 and spaced inwardly from the other edge portion 50 to form a base flange 28.

Figure 5:
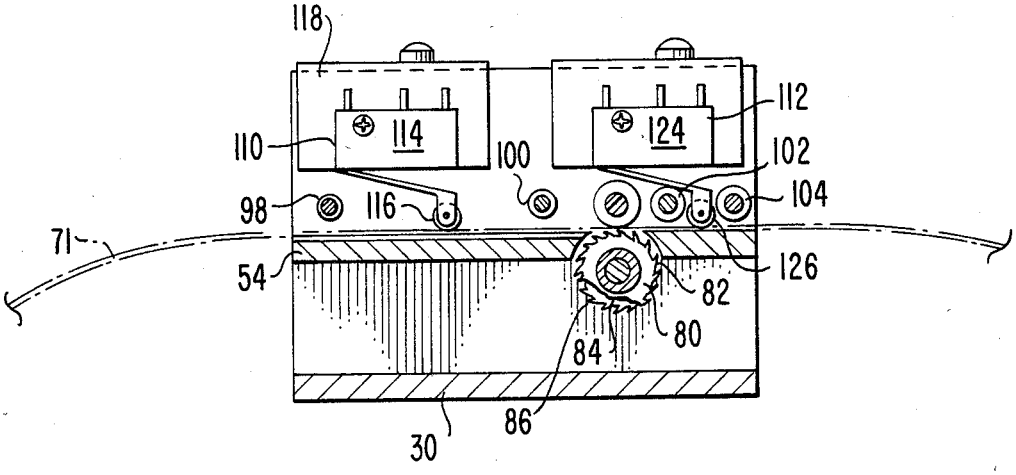
Figure 6:
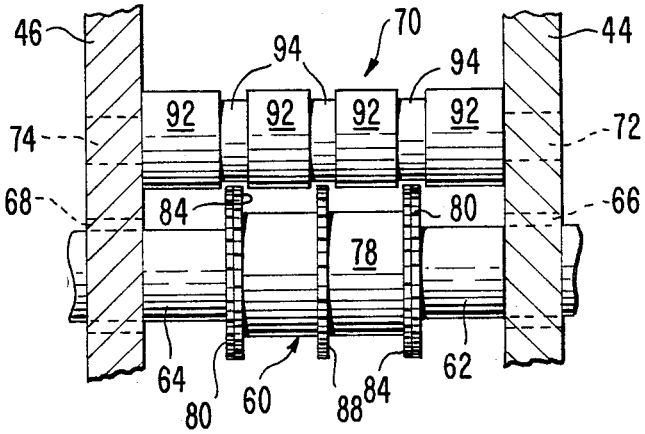

A ticket feed plate 54 is mounted between first and second side plates 44 and 48 respectively and is spaced upwardly from the base 30 and generally parallel thereto. A plurality of screws 56 secure the ticket feed plate 54 to the first and second side plates. Referring to FIGS. 5 and 6 the feed wheel assembly 60 is supported by end shafts 62 and 64 rotatably carried in bearings 66 and 68, shown in dotted lines in FIG. 6, mounted in the first and second side plates 44 and 46 respectively. Back up roll 70 is rotatably carried between first and second side plates 44 and 46 by means of stub shafts 72 and 74. The back up roll 70 is made of a self-lubricating material, such as nylon or teflon for example. More specifically, feed wheel 60 includes a circular body 78 onto which are fitted both drive and brake members. Each of the outside drive portions of the feed wheel 60 include a toothed wheel 80 having teeth 82 positioned for gripping the ticket in a counter clockwise direction as viewed in FIG. 5 and a toothed wheel 84 having teeth 86 positioned for gripping the ticket in a clockwise feed direction as viewed in FIG. 5. The center toothed wheel 88 has teeth for feeding the ticket in a clockwise direction.

A previously described, back up roll 70 is rotatably carried by stub shafts 72 and 74. The back up roll 70 includes roll portion 92 adapted to maintain the ticket strip in close association with the ticket feed plate 54. The back up roll 70 also includes annular recessed portions 94 aligned with the three sets of toothed wheels 80–84, 88, 84–80. It should be noted that the toothed portions of said wheels extend into the recesses 94 a slight amount so as to firmly engage the ticket strip 71. In order to make certain that the ticket strip 71 moves smoothly along the ticket feed plate 54 a plurality of guide rolls 98, 100, 102 and 104 are rotatably carried between the first and second side plates 44 and 48 immediately above the ticket feed plate 54.

In order to provide rotative force to feed wheel 60, motor shaft 24 mounts a worm gear 101 which meshes with spur gear 103 affixed to feed wheel 60. This is a particularly advantageous arrangement since the pitch of the worm gear 101 and number of teeth of the spur gear 102 provide the requisite r.p.m. reduction.

There is yet another advantage, namely that this gearing combination does not allow for movement therefore it would not be possible to pull on the ticket strip and obtain any ticket feed because the worm gear 101 will prevent rotation of spur gear 103.

For purposes of controlling operation of the ticket dispenser, the unit is provided with a ticket sensor and counter switch assembly 110 and an anti-jam switch assembly 112. As best shown in FIGS. 1–5, the ticket sensor and counter switch assembly 110 comprises a switch element 114 carrying a spring mounted roller 116. The ticket sensor and counter switch 110 is adjustably carried on bracket 118 which in turn is adjustably mounted on first side plate 44 by means of screw 120 and slot 122. Similarly, anti-jam switch assembly 112 comprises a switch element 124 mounting a spring supported roller 126. The anti-jam switch assembly 120 is adjustably mounted on the first side plate 44 by means of bracket 130 which in turn is adjustably mounted on the first side plate 44 by means of screw 132 and slot 134.

In operation, with a ticket strip 71 in place in the ticket feed mechanism 40 so that roller 116 may sense the presence of the ticket strip, the motor is activated to cause worm gear 101 to rotate and thereby rotate spur gear 103 with which it meshes to rotate feed wheel 60 in a clockwise direction when viewed in FIG. 5. The teeth on three drive wheels 84, 88, and 84 engage and grip the surface of the ticket strip 71 to feed same from left to right as shown in FIG. 5. The teeth on the drive wheels are slanted so as to dig into the ticket strip surface to feed the tickets as described. After the prescribed number of tickets have been dispensed the motor stops and likewise all feed. Should someone attempt to obtain the feed of additional tickets, the teeth on brake wheels 80—80 will engage the ticket strip 71 and since the spur gear is retained in a fixed position by worm gear 101 when the power is off the feed wheel 60 will not rotate whereby no additional tickets may be withdrawn. In other words, the feed wheel 60 is provided with oppositely directed teeth as separate toothed wheels, one set for feeding the ticket strip and another set for engaging the ticket strip should movement of the ticket strip take place by the pulling of the strip to try to extract additional tickets. The worm gear will prevent rotation of the spur gear thus preventing rotation of the feed wheel 60. Obviously, other types of mechanisms could be provided to prevent rotation of the feed wheel to prevent withdrawal of undeserved tickets.

In addition, the feed wheel 60 for feed purposes could be provided with means other than toothed elements such as rubber elements.

What is claimed is:

1. A ticket strip feed machine comprising a ticket strip feed mechanism, a power means and gearing means operatively connecting the power means with the ticket strip feed mechanism, said ticket strip feed mechanism having a ticket strip feed wheel operatively connected to the gearing means, said feed wheel having a first means thereon in engagement with the ticket strip for effecting ticket strip feed upon rotation of said feed wheel, and a second means thereon adapted to engage the ticket strip and prevent additional feeding movement of the ticket strip when a force is exerted on the ticket strip in the direction of feed and the feed wheel is stationary.

2. The invention as set forth in claim 1 and wherein the power means includes a motor having a drive shaft extending outwardly therefrom and the gearing means includes a worm gear connected to the drive shaft, and a spur gear connecting the worm gear with the ticket strip feed wheel whereby when the worm is not in motion the ticket strip feed wheel cannot be rotated.

3. The invention as set forth in claim 1 and wherein the second means on the ticket strip feed wheel comprises at least one set of toothed elements adapted to engage the ticket strip and prevent additional feeding movement of the ticket strip when a force is exerted on the ticket strip in the direction of feed and the feed wheel is stationary.

4. The invention as set forth in claim 3 and wherein the first means on the ticket strip feed wheel comprises a plurality of toothed elements for engaging the ticket strip and effecting ticket strip feed upon rotation of the ticket strip feed wheel.

5. The invention as set forth in claim 4 and wherein the power means includes a motor having a drive shaft extending outwardly therefrom and the gearing means includes a worm gear attached to said drive shaft and a spur gear connecting the drive shaft with the ticket strip feed wheel whereby when the worm is not in motion the ticket strip feed wheel cannot be rotated.

6. The invention as set forth in claim 4 and wherein the toothed elements on the first means are slanted in the direction of ticket strip feed and further wherein the toothed elements on the second means are slanted away from the direction of feed.

* * * * *